United States Patent [19]

Powers

[11] 4,219,194

[45] Aug. 26, 1980

[54] JIGSAW PUZZLE GAME

[76] Inventor: Robert B. Powers, 294 Lincoln Rd., Grosse Pointe, Mich. 48230

[21] Appl. No.: 959,576

[22] Filed: Nov. 13, 1978

[51] Int. Cl.[2] ..... A63F 9/10

[52] U.S. Cl. ..... 273/54 B

[58] Field of Search ..... 273/157 R

[56] References Cited

U.S. PATENT DOCUMENTS

| | | | |
|---|---|---|---|
| 2,659,163 | 11/1953 | Albee | 273/157 R X |
| 3,010,723 | 11/1961 | Moss | 273/157 R |
| 3,558,136 | 1/1971 | McFarland | 273/157 R |

FOREIGN PATENT DOCUMENTS

| | | | |
|---|---|---|---|
| 436076 | 11/1967 | Switzerland | 273/157 R |
| 553798 | 6/1943 | United Kingdom | 273/157 R |

OTHER PUBLICATIONS

"A Mechanical Intensity Shading Map", by R. von Huhn, The American Statistical Association Journal, Dec. 1938, vol. 33, p. 713.

*Primary Examiner*—Anton O. Oechsle

*Attorney, Agent, or Firm*—Barnes, Kisselle, Raisch & Choate

[57] ABSTRACT

A game having a first set of at least two preferably identical jigsaw puzzles and a second set of at least two essentially identical jigsaw puzzles with the pieces of each puzzle having identifying indicia thereon and being interchangeable with corresponding pieces of the other puzzles of the second set. Each player takes one puzzle from each set and all players simultaneously begin to assemble their puzzles from the first set. Each player upon completion of assembly of his puzzle from the first set begins to assemble a common puzzle utilizing the pieces from his second set. The player assembling the most pieces of the completed common puzzle is the winner of the game.

7 Claims, 2 Drawing Figures

JIGSAW PUZZLE GAME

This invention relates to a game and more particularly to a jigsaw puzzle game.

Objects, features and advantages of this invention are to provide a jigsaw puzzle game which is interesting, stimulating, challenging, creates a desire to repeatedly play the game, may be designed to appeal to and be played by both children and adults, and may be rugged, durable and of economical manufacture.

Figure 1:
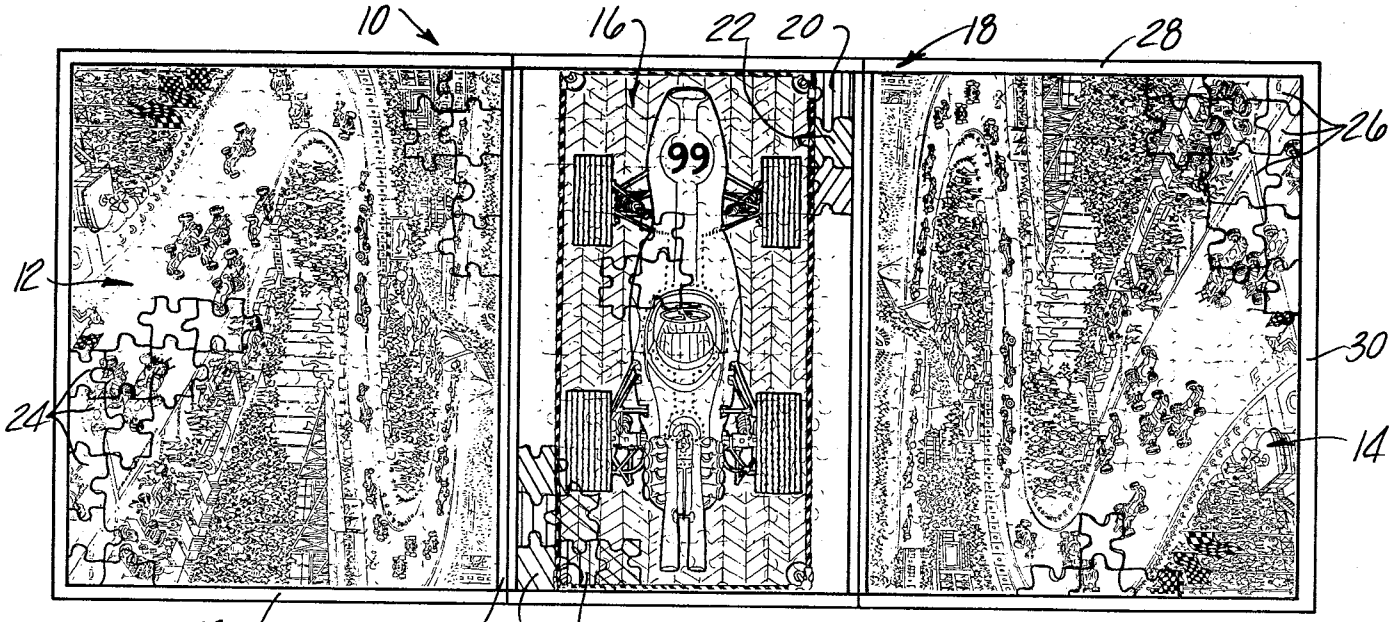
Figure 2:
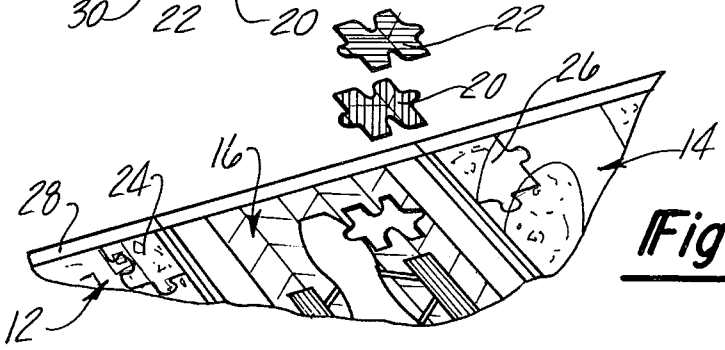

These and other objects, features and advantages of this invention will be apparent from the following detailed description, appended claims and accompanying drawing in which:

FIG. 1 is a plan view of a jigsaw puzzle game embodying this invention showing two essentially identical puzzles of a first set, each assembled and received in one end of a frame, and a common puzzle assembled from interchangeable pieces of a second set of two essentially identical puzzles and received in a central portion of the frame; and FIG. 2 is an enlarged fragmentary plan view of a portion of the game of FIG. 1 illustrating two interchangeable pieces colored red and green, each from one of the two puzzles of the second set, and either of which may be assembled in the same location in the common puzzle in the center of the frame.

Referring in more detail to the drawing, FIG. 1 illustrates a jigsaw puzzle game 10 for two players after both puzzles 12 and 14 from a first set of jigsaw puzzles and a common puzzle 16 from pieces of two essentially identical puzzles of a second set of jigsaw puzzles have been completely assembled in the end portions and center portion respectively of a frame 18 received on a table or other flat supporting surface. In playing game 10 each player receives all of the pieces to one of the puzzles of each of the two sets of puzzles and the players begin at the same time to each assemble the pieces of his puzzle 12 or 14 from the first set in one of the ends of the frame 18. Upon completing assembly of all of the pieces of his puzzle 12 or 14 of the first set, each player begins to assemble the common puzzle 16 in the center portion of the frame 18 from the pieces of his puzzle of the second set and the player who assembles the most pieces of the common puzzle 16 wins the game. To enable each player to determine the number of pieces which he has assembled in the common puzzle 16, each of the pieces 20 and 22 of each of the puzzles of the second set are marked with some identifying indicia, such as the colors red and green in the background of the portion of the picture on the upper face of each piece.

Preferably, jigsaw puzzles 12 and 14 of the first set are essentially the same with the same number of pieces 24 and 26 and the same picture on the upper face thereof. The puzzles of the second set have the same picture on the upper face of the pieces 20 and 22, the same number of pieces, and as illustrated in FIG. 2 corresponding pieces with essentially the same configuration so that corresponding pieces are interchangeable and either of the corresponding pieces may be used in assembling the common puzzle 16.

Preferably, the subject matter of the pictures on the puzzles of the first and second sets have an interrelated or common theme. For example, in the game 10 illustrated in the drawing, the puzzles of the first set have the identical picture of a Monte Carlo road racing scene and the puzzles of the second set have the identical picture of a road racing car. When the game 10 is designed for adult players, it can usually be played in about 30 to 45 minutes if the puzzles of the first set are essentially identical and have the same number of pieces in the range of 80 to 100 pieces in each puzzle; and the puzzles of the second set are essentially identical and have the same number of pieces in the range of about 25 to 35 pieces in each puzzle. The pieces of the puzzles may be formed from a variety of materials including sheet materials of cardboard, paperboard, hardboard, wood and the like.

While frame 18 facilitates playing of game 10, it will be appreciated that this game can be played without utilizing the frame. The frame is made from a plurality of lightweight, longitudinal members 28 and 30 of materials such as bristol board, plastic, wood and the like. If desired, frame 10 may be formed in three rectangular sections secured together by hinges to permit the frame to be folded into a more compact configuration for shipment and storage. If desired, a thin sheet of a material such as paperboard may be secured to the underface of each rectangular section of the frame to provide rectangular trays in which the puzzles 12, 14 and 16 may be assembled.

I claim:

1. A jigsaw puzzle game comprising a first set of at least two jigsaw puzzles with all of the puzzles of the first set having essentially the same picture, the same number of pieces, and corresponding pieces having the same configuration and being interchangeable, and a second set of at least two jigsaw puzzles with all of the puzzles of the second set having essentially the same picture, the same number of pieces, and corresponding pieces having the same configuration and being interchangeable so that each player can utilize pieces from one of the puzzles of the second set in assembling a single common jigsaw puzzle, which, when assembled, may contain some of the pieces from each of the puzzles of the second set, at least one of the picture and configuration of the pieces of said first set of puzzles differing from at least one of the picture and configuration of the pieces of said second set of puzzles, each piece of each puzzle of said second set having indicia thereon identifying the particular puzzle of said second set to which such piece belongs, each player being assigned one puzzle from each set, and each player completing assembly of his assigned puzzle from said first set before beginning to assemble the common puzzle by utilizing pieces from his assigned puzzle of said second set.

2. The jigsaw puzzle game of claim 1 wherein said indicia for the pieces of one of the puzzles of the second set comprises the same color applied to the upper face of each of the pieces of one of the puzzles of the second set,

3. The jigsaw puzzle game of claim 1 wherein the puzzles of the first set each have essentially the same picture, the same number of pieces, and corresponding pieces which are essentially the same.

4. The jigsaw puzzle game of claim 1 which also comprises a frame having a center portion in which the common puzzle may be assembled and end portions adjacent opposite sides of the center portion in each of which one of the puzzles of the first set may be assembled.

5. The jigsaw puzzle game of claim 1 which is constructed and arranged such that all of the players begin assembling one of the puzzles of the first set at the same time, each player utilizing pieces from only one of the puzzles of the second set begins assembly of the common puzzle only after completing assembly of his one puzzle of the first set, and the player who assembles the most pieces of the common puzzle wins the game.

6. The jigsaw puzzle of claim 5 wherein said first set of puzzles has two puzzles and said second set of puzzles has two puzzles.

7. The jigsaw puzzle game of claim 1 wherein said first set of puzzles has two puzzles and said second set of puzzles has two puzzles.

* * * * *